United States Patent [19]

Bischofberger et al.

[11] 4,275,392

[45] Jun. 23, 1981

[54] METHOD AND APPARATUS FOR MONITORING THE GAS VOLUME OF A HYDROPNEUMATIC STORAGE UNIT

[75] Inventors: Walter Bischofberger, Zurich; Norbert Zeller, Ennetbaden, both of Switzerland

[73] Assignee: BBC Brown Boveri & Company Limited, Baden, Switzerland

[21] Appl. No.: 957,068

[22] Filed: Nov. 3, 1978

[30] Foreign Application Priority Data

Nov. 4, 1977 [CH] Switzerland ..... 13429/77

[51] Int. Cl.[3] ..... G08B 21/00

[52] U.S. Cl. ..... 340/606; 340/608; 137/208; 73/196

[58] Field of Search ..... 340/606, 607, 608, 611, 340/614, 626; 73/40, 40.5 A, 40.5 B, 196, 198, 205; 60/416, 418, 413; 417/300; 137/255, 206, 208, 209

[56] References Cited

U.S. PATENT DOCUMENTS

| | | | |
|---|---|---|---|
| 1,240,373 | 9/1917 | Roszkowski | 137/208 |
| 2,365,091 | 12/1944 | Levy | 60/418 |
| 2,764,999 | 10/1956 | Stanbury | 60/416 |
| 3,050,003 | 8/1962 | Edwards | 340/611 |
| 3,300,769 | 1/1967 | Batur | 340/608 |
| 3,366,942 | 1/1968 | Deane | 340/608 |
| 3,473,549 | 10/1969 | Moyer | 137/209 |
| 3,965,317 | 6/1976 | Gratzmuller | 340/614 |
| 4,152,925 | 5/1979 | Lindh | 73/196 |

*Primary Examiner*—Gerald L. Brigance

*Attorney, Agent, or Firm*—Burns, Doane, Swecker & Mathis

[57] ABSTRACT

A method and apparatus to monitor a compressible gas volume of one or more hydropneumatic storage tanks of an energy-storing system includes at least one pump to fill the individual storage tanks with hydraulic fluid. The fluid is isolated from the gas volume in each storage tank or unit by a movable partition. The gas volumes of the storage tanks are monitored continuously and free of error for the early detection and signaling of gas volume losses by the use of a minimum of maintenance-free devices. The monitoring is accomplished by determining the state of flow of the hydraulic fluid entering the several hydropneumatic storage tanks while the pump is running. In the event of a coincidence of a running pump and an interruption of the flow to a tank, a loss of gas volume is indicated. A flow monitor having a control contact within each pipeline supplying the hydraulic fluid as well as a signal device for indicating the pump operation is provided. In each storage unit, a stop limits the movement of a free piston which separates the fluid and gas. Furthermore, an additional gas storage tank may be connected with the hydropneumatic storage unit.

17 Claims, 5 Drawing Figures

METHOD AND APPARATUS FOR MONITORING THE GAS VOLUME OF A HYDROPNEUMATIC STORAGE UNIT

BACKGROUND AND SUMMARY OF THE PRESENT INVENTION

The present invention relates generally to methods and devices for monitoring the gas volumes of storage tanks.

A known hydropneumatic storage tank is disclosed in the published German patent application No. 2,431,605 which includes a pressure cylinder. The inside space of the pressure cylinder is divided by a partition, preferably by a free moving piston, into two chambers. One chamber is filled with a compressible gaseous medium such as nitrogen, and the other chamber is filled to a greater or lesser extent with an hydraulic fluid such as oil at a specified amount depending on the existing working conditions. The German patent discloses a gas-pneumatic, fluid-pressure storage unit or a hydropneumatic storage unit having a free piston arranged in the pressure cylinder between one fluid-pressure chamber and one gas-pressure chamber.

A permanent magnet moves alongside the pressure cylinder in relation to the position of the free piston, with the pressure cylinder being of a magnetizable metal, preferably steel. One of the cylinder covers is made of a non-magnetic material, and there is imbedded in at least one blind-end bore of the cylinder cover a magnetically actuated switch, preferably a reed switch in a sealed envelope. The reed switch forms a part of an electric circuit to monitor the position of the free piston. The moving permanent magnetic is placed in the pressure chamber which is closed off by the non-magnetic cylinder cover. An engaging device is provided between the free piston and the permanent magnet which engaging device will move the permanent magnet into the switched-on position when the spacing of the free piston with the cylinder cover is less than a predetermined minimum value. Such a gas-pneumatic, fluid-pressure storage tank, however, can not be readily installed or replaced, as is typically necessary in the case of standard storage tanks. Any installation at a later time of such tanks involves considerable changes and work on the drive system of the storage tanks, especially if the storage tank includes an energy-storage system for an electrical switch gear.

Even a simplification of the above-described gas-pneumatic fluid-pressure storage tank by utilizing a rod which penetrates the storage tank as a direct indicator for the position of the free piston will require the use of an additional and delicate dynamic seal. The tightness of the seal can never be guaranteed, not to mention the fact that undesirable frictional forces will arise between the indicating rod and the seal.

The Swiss Pat. No. 468,592 discloses a method to monitor the gas volume of a hydropneumatic storage tank which requires the use of a pump to fill the unit with hydraulic fluid. A manometer measures the storage tank pressure in order to determine a functional relationship between the pressure gradient which exists during the operational filling of the storage unit and the volume entering the storage unit. The method of the Swiss patent determines either the maximum permissible pressure difference, assigned to a specific filling volume, or the permissible minimum volume, assigned to a specific pressure difference. The monitoring of the filling volume is accomplished in the case of this method by utilizing the time period of the pump operation.

It is also known to count a specific number of revolutions by the pump shaft with a reduction gear. The gear can then actuate a switch when the pump shaft has performed a specific number of revolutions. If, due to a leak in the storage tank, a loss in gas volume occurs, the volume will drop below a certain magnitude. Then the pressure or respectively the pressure difference based on a specific filling volume will exceed a permissible maximum value and the loss of gas can be signaled by a pressure switch contact. The measurement of the pressure gradient based on a predetermined pump running time is subject to error, however, because the filling volume produced by the pump will vary since it depends on the existing temperatures. If oil is being used as the hydraulic fluid, the filling volume also depends on the viscosity of the oil. Fluctuations in the electric voltage of the pump motor will also lead to the delivery of dissimilar quantities within identical time units. Furthermore, wear and tear of the pump will influence the quantity being delivered. Finally, the hysteresis and the repetitive stability of pressure switches is such that they will not always switch at precisely the same trigger slack.

Accordingly, it is an object of the present invention to monitor, in the most simple manner, with a minimum number of maintenance-free devices, and continuously and free of error, the gas volumes of hydropneumatic storage units of an energy-storing system for the purpose of rapidly detecting and reporting a loss of gas volume.

The present invention accomplishes this and other objects by determining the state of flow of the hydraulic fluid entering the several hydropneumatic storage tanks while the pump is running. The coincidence of a running pump and a stoppage of flow is the criterion that is used by the monitoring system to detect a loss of compressible gas volume.

In a preferred embodiment of the invention, an appropriate pipeline supplies hydraulic fluid to the individual hydropneumatic storage tanks. The tanks are fed in parallel by way of a central pipeline with at least one flow monitor and an alarm which can be triggered by the flow monitor.

It will be especially advantageous if the movable partition in the storage tank is formed by a free piston, and if the housing or respectively the pressure cylinder of the storage tank serves as the guide for the free piston. In this way, the presence of a specifically selected gas volume reserve for the operational requirements of the energy-storing system or respectively the appropriate utilization of this system is maintained. For this same reason it will be further advantageous if the housing or respectively the pressure cylinder of the hydropneumatic storage tank which serves as the guide for the free piston, and holds a gas volume that is determined by the specific position of the free piston at any given time, will be in continuous communication with another gas storage tank through a connecting pipeline that is open at all times.

Finally, it is advantageous if the pump is equipped with a second signal device that is controlled by the running pump.

The present invention eliminates the disadvantages of the known systems and arrangements and in particular has the further advantage that it can be consummated by rather simple devices that are safe in operation and are commercially available. The installation, especially of the flow monitors, in already existing systems can be accomplished with a minimum of effort. A particular object of the present invention is that the monitoring system according to the present invention is especially distinguished by its independence from upsetting exterior as well as interior influences such as temperature, fluctuations in electric voltages, or in pump revolutions, irregularities due to wear and tear of the pump, the consequences of pressure switch hysteresis or the respective stability of such switches with respect to their triggering.

BRIEF DESCRIPTION OF THE DRAWINGS

A preferred embodiment of the present invention is illustrated with reference to the accompanying drawings wherein like members bear like reference numerals and wherein.

DETAILED DESCRIPTION OF THE PREFERRED EMBODIMENTS

Figure 1A:
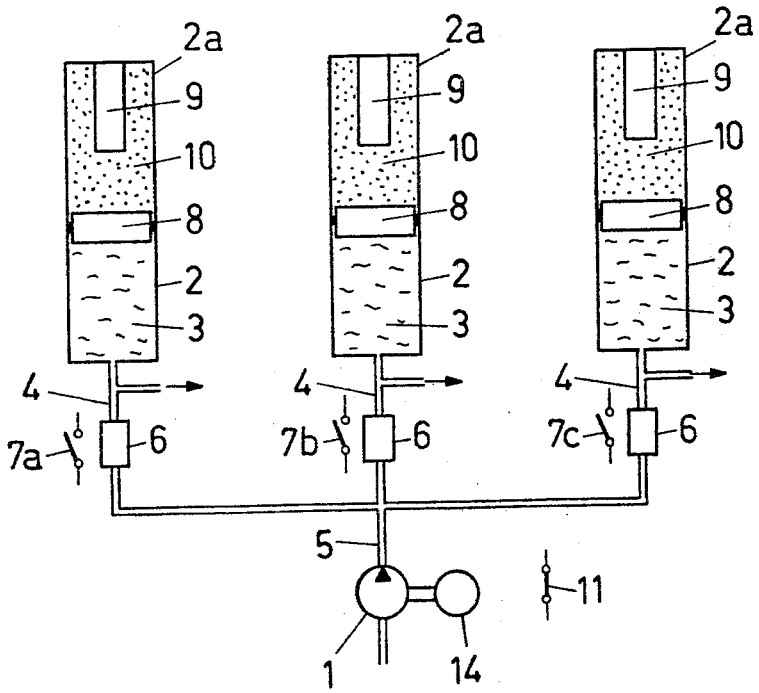
FIG. 1*a* is a schematic illustration of an energy-storing system having hydropneumatic storage tanks and a monitoring system according to the present invention.

With reference to FIG. 1*a,* a pump which is driven by an electric motor 14 supplies hydraulic fluid 3 to a plurality of hydropneumatic storage tanks 2. The tanks 2 include housings 2*a* or pressure cylinders with the hydraulic fluid 3 being supplied by a pipeline 4 to the several storage tanks 2. The hydraulic fluid is carried by a central pipeline 5 which feeds the entire energy-storing system. Each branch of the central pipeline 5 includes one of a plurality of flow monitors 6 with each monitor 6 including one of a plurality of first signal devices 7*a, 7b, 7c* (or controlling contacts). A second signal device 11 (or controlling contacts) is arranged at the pump 1.

A free piston 8 is provided in each storage tank 2 with a stop 9 also arranged in each storage unit 2 to limit movement of the piston. A volume of gas 10 is present within each storage tank 2 and is in communication with the stop 9. Finally, with reference to FIG. 3*a,* another embodiment of the storage unit of the present invention includes an additional gas storage tank 13 which is connected by a pipeline 12 with the interior of the hydropneumatic storage unit 2'.

Figure 1B:
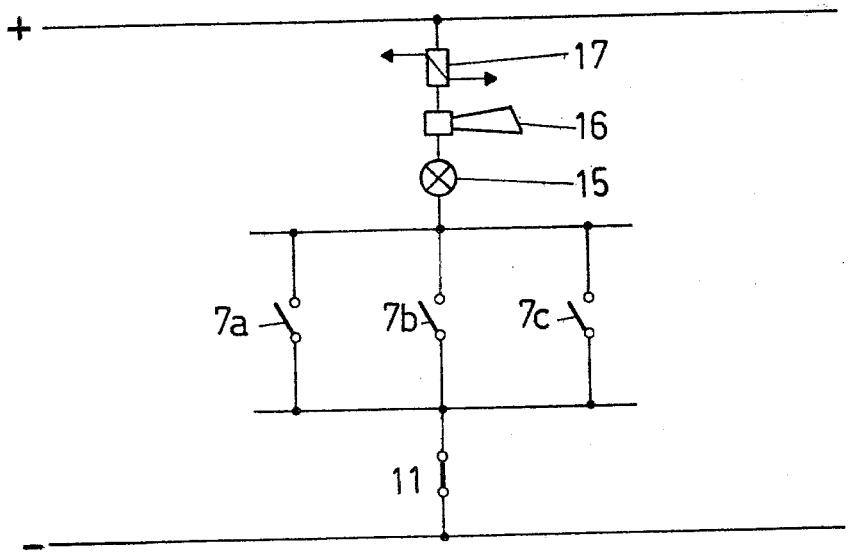
FIG. 1*b* is a schematic illustration of a control circuit during normal operation with the pump running and the hydraulic fluid flowing through all pipelines supplying such fluid.
Figure 2A:
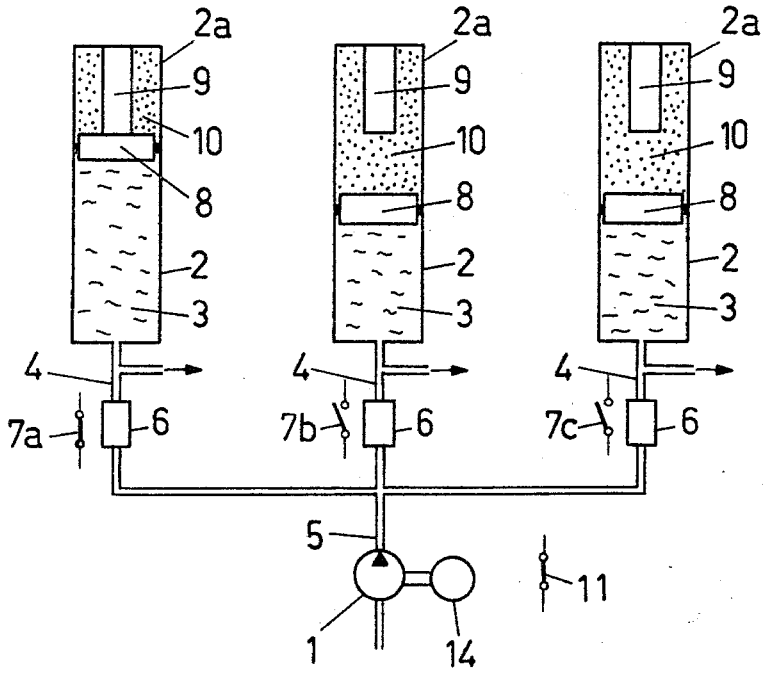
FIG. 2*a* is a schematic illustration of the system of FIG. 1*a* with a free piston moved up to a stop arranged within the tank due either to a leak in a hydropneumatic storage tank, or due to a gas volume loss.

The arrows shown in FIGS. 1*a* and 2*a* are to indicate that the pipelines lead to the drives of a set of electric switches or to a three-phase electric switch. As a result of a switching operation, valves (not illustrated) which are located in the last-mentioned pipelines will open. The expanding gases in the gas volumes 10 will cause the actuation of the proper drives of the set of switches or the multi-switch respectively as a result of the flow of the hydraulic fluid 3 which is thereby generated. In this way, the free pistons 8 will move towards the ends of the storage units 2 which face the flow monitors. Since the pump 1 is now at rest, the second contact 11, controlled by the pump, will be open and thereby deactivate the signaling or controlling circuit of FIG. 1*b.* If the pump 1 is now started following the switching operation by an actuation of the electromotor 14, the pump will then return the signaling circuit to the arrangement illustrated in FIG. 1*a* after a certain running time.

While the pump 1 is operating, the second control contact 11 will be closed although the first control contacts 7*a, 7b* and 7*c* are open due to the presence of a flow within the pipelines 4 which carry the hydraulic fluid. Accordingly, the signaling or controlling circuit of FIG. 1*b* is deactivated again so that a signal lamp 15, an alarm 16 and a relay 17 will not be activated.

With reference now to FIG. 2*a,* an operational condition is illustrated where during the recharging of an energy-storing tank, (that is with the pump 1 in operation), the free piston 8 has moved due to an undue loss of gas volume in one of the storage tanks 2 up to a stop 9 which is located inside this tank. The movement of the piston 8 will cause an interruption of the flow of hydraulic fluid in the pipeline 4 which supplies the defective storage unit with hydraulic fluid. The flow monitor 6, located within this pipeline 4, will accordingly close the first signaling contact 7*a.*

Figure 2B:
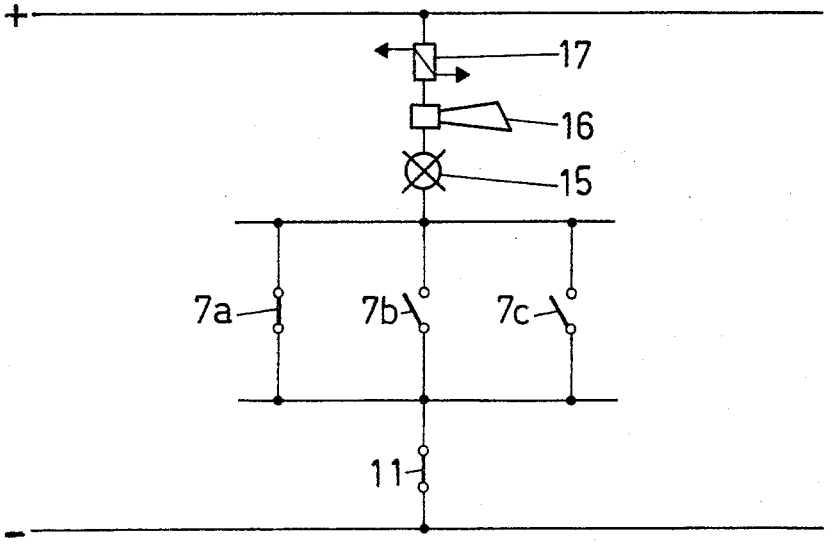
FIG. 2*b* is a schematic illustration of the control circuit of FIG. 1*b* during the operational conditions described with reference to FIG. 2*a;* and, FIG. 3 is a schematic illustration of another embodiment of a hydropneumatic storage tank.

The closed signaling (or controlling) circuit, illustrated in FIG. 2*b,* is thereby established with the signal lamp 15 as well as the alarm 16 activated and the relay 17 energized, thereby triggering the automatic steps provided for such malfunction. The lamp 15, alarm 16 and relay 17 are serially connected with the first and second control contacts. Each of the first control contacts are arranged in parallel with one another.

Figure 3:
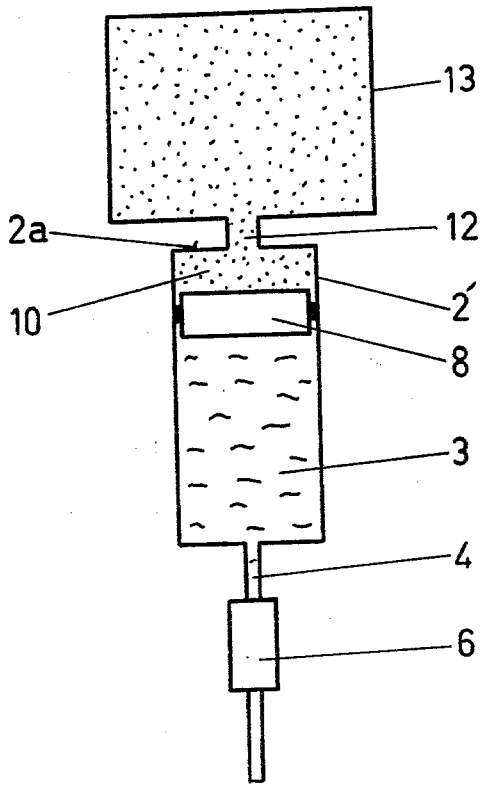

With reference to FIG. 3, another embodiment of a hydropneumatic storage tank according to the present invention includes the tank 2' having a chamber which is in continuous communication with another gas storage tank 13 by a connecting pipeline 12. The pipeline 12 is located at the top of the gas-containing section of the housing 2*a.* The stop 9 and/or the gas storage unit 13 can be arranged and dimensioned in accordance with the specific conditions of the system as desired. In this way, in the event of a break-down and at the moment of alarm the energy storing system or respectively the affected individual hydropneumatic storage tanks 2 will still contain a relatively large quantity of gas. The large quantity of gas is preferably sufficient so that interruptions in service are avoided until a change-over can be made to provisional or alternative operations or by way of inter-switching.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A method for monitoring a compressible fluid volume in at least one storage unit, comprising the steps of:

pumping a relatively incompressible fluid into a first portion of the at least one storage unit with a pump to compress a relatively compressible fluid within a second portion of the at least one storage unit;

sensing that the pump is functioning to generate fluid pressure;

sensing that said relatively incompressible fluid is flowing into the at least one storage unit; and, triggering an alarm whenever the flow of said relatively incompressible fluid into the at least one storage unit is interrupted while the pump is functioning.

2. The method of claim 1 further comprising the steps of:

closing a switch of an electrical circuit when the pump is functioning; and closing another switch of the electrical circuit whenever the flow of said relatively incompressible fluid into the at least one storage unit is interrupted while the pump is functioning.

3. A method for monitoring a gas volume in at least one hydropneumatic storage tank of an energy storage system, comprising the steps of:

pumping a hydraulic fluid into the at least one hydropneumatic storage tank with a pump to compress the gas volume;

generating a signal which indicates that the pump is functioning to generate fluid pressure by closing a switch of an electrical circuit;

generating a signal which indicates that hydraulic fluid is flowing into the at least one hydropneumatic storage tank by opening another switch of the electrical circuit; and detecting a loss of volume of the gas within the storage tank by closing said another switch during an interruption of said flow of said hydraulic fluid into the storage tank when the switch is closed to indicate that the pump is functioning.

4. The method of claim 3 further comprising the step of:

triggering an alarm whenever both of said switches are closed.

5. Apparatus for monitoring a compressible fluid volume in a storage unit, comprising:

storage means for receiving a relatively compressible fluid and a relatively incompressible fluid;

means for separating said relatively compressible and said relatively incompressible fluids within said storage means;

pumping means for pumping the relatively incompressible fluid into the storage means;

first means for determining that the pumping means is functioning to generate fluid pressure;

second means for determining that flow of the relatively incompressible fluid into the storage means is interrupted; and alarm means for signaling an alarm whenever both the first means determines that the pumping means is functioning and the second means determines that flow of the relatively incompressible fluid into the storage means is interrupted.

6. The apparatus of claim 5 wherein the storage means includes a plurality of storage tanks each of which selectively communicate with the pumping means.

7. The apparatus of claim 6 wherein the second means includes a plurality of flow monitors, each flow monitor corresponding to one of the plurality of storage tanks.

8. The apparatus of claim 7 wherein the first means includes an electrical switch which is closed when the pumping means is functioning and open during standstill of the pumping means.

9. The apparatus of claim 6 wherein the relatively compressible fluid in each storage tank is a gas and wherein the relatively incompressible fluid pumped by the pumping means is a hydraulic fluid.

10. The apparatus of claim 9 wherein:

the means for separating said relatively compressible and said relatively incompressible fluids includes a plurality of movable partitions, each partition provided in one of said storage tanks to separate the compressible gas from the hydraulic fluid.

11. The apparatus of claim 10 further comprising:

means for limiting movement of the movable partitions in the direction of the compressible gas.

12. The apparatus of claim 11 wherein said means for limiting movement of the movable partitions includes a plurality of stop members, each stop member being provided in an interior of one of the storage tanks in communication with the compressible gas.

13. The apparatus of claim 8 wherein each of the flow monitors includes an electrical switch which is open when fluid is flowing into the respective storage tank and closed when flow of the fluid into the respective storage tank is interrupted.

14. The apparatus of claim 13 wherein each of the electrical switches of the flow monitors is serially connected with the electrical switch of the first means.

15. Device for monitoring gas quantities of hydropneumatic reservoirs of an energy accumulator system, comprising a variable-position free piston arranged in each reservoir between a respective compressible gas and an incompressible liquid, a housing serving as a guide for each free piston, said housing being a pressure cylinder of the respective hydropneumatic reservoir and having a stop within the cylinder which stop limits the movement of the free piston, a monitoring device having at least one pump for replenishing the reservoirs with liquid and having control contacts in a control circuit, a flow monitor arranged between each reservoir and the pump in a respective liquid feed pipe, said flow monitor contains a first control contact which is actuated when flow of the liquid is interrupted, the pump having a second control contact which is actuated to indicate that the pump is functioning to generate fluid pressure, a parallel array of the first control contacts is connected in series with the second control contact in the control circuit, whereby an alarm signal is developed when there is sufficient gas loss in the energy accumulator system by actuation of both one of the first control contacts and the second control contact.

16. Device according to claim 15, wherein the first control contact comprises a contact which is closed at zero flow of the liquid and open with the presence of flow in the respective liquid feed pipe.

17. Device according to claim 15, wherein the second control contact comprises a contact which is closed when the pump is functioning to generate fluid pressure and open when the pump is not functioning.

* * * * *